US005634281A

United States Patent [19]

Nugent

[11] Patent Number: 5,634,281

[45] Date of Patent: Jun. 3, 1997

[54] MULTI PASS, CONTINUOUS DRYING APPARATUS

[75] Inventor: James E. Nugent, Lafayette, La.

[73] Assignee: Universal Drying Systems, Inc., St. Louis, Mo.

[21] Appl. No.: 440,909

[22] Filed: May 15, 1995

[51] Int. Cl.[6] ..... F26B 19/00

[52] U.S. Cl. ..... 34/207; 34/215; 34/217

[58] Field of Search ..... 34/207, 210, 215, 34/216, 217, 164, 420

[56] References Cited

U.S. PATENT DOCUMENTS

| | | | |
|---|---|---|---|
| 2,513,368 | 7/1950 | Shabaker | 34/207 |
| 3,744,145 | 7/1973 | Maxwell et al. . | |
| 3,854,864 | 12/1974 | Mendoza | 34/207 |
| 4,050,900 | 9/1977 | Hobbs et al. . | |
| 4,196,527 | 4/1980 | Escande | 34/207 |
| 4,253,825 | 3/1981 | Fasano | 34/215 |
| 4,330,946 | 5/1982 | Courneya . | |
| 4,380,496 | 4/1983 | Maffet . | |
| 4,455,478 | 6/1984 | Guibert | 34/215 |
| 4,569,658 | 2/1986 | Wiggins et al. | 34/217 |
| 4,610,886 | 9/1986 | Buller-Colthurst | 34/216 |
| 4,882,851 | 11/1989 | Wennerstrum et al. . | |
| 4,939,346 | 7/1990 | Bailey et al. . | |
| 4,993,943 | 2/1991 | Norris et al. . | |
| 5,143,626 | 9/1992 | Nugent . | |
| 5,373,647 | 12/1994 | Bernes et al. | 34/420 |

*Primary Examiner*—John T. Kwon

*Attorney, Agent, or Firm*—Price, Heneveld, Cooper, DeWitt & Litton

[57] ABSTRACT

An apparatus for drying moist solid or semi-solid materials, such as sewerage sludge, municipal waste, industrial waste, agricultural waste, and the like, includes a dryer unit having a plurality of stacked heating chambers, each of the heating chambers above the lowest heating chamber having a conveyor belt for transporting the material through the associated heating chamber and depositing it on a lower heating chamber, the lowest of the stacked heating chambers including a conveyor belt for transporting the material therethrough and discharging the material from the dryer unit. The apparatus utilizes a combination of convective heat transfer, in the form of a heated gas which rises upwardly through the dryer unit through successive heating chambers, and radiative heat transfer, provided by radiative heating units disposed above the conveyor belt in each heating chamber. The speed of the conveyor belts can be individually controlled to allow more effective utilization of the drying and material handling capacity of the drying apparatus. The stacked heating chamber arrangement results in a more compact dryer which requires less floor area than a dryer having a single linear heating chamber. The stacked heating chamber arrangement also results in lower heat losses through the walls, floor, and top of the dryer housing.

18 Claims, 6 Drawing Sheets

MULTI PASS, CONTINUOUS DRYING APPARATUS

BACKGROUND OF THE INVENTION

This invention relates to an apparatus for removing liquids from various moist or mucky solid or semi-solid materials such as sewerage sludge, industrial waste, agricultural waste, animal waste, waste from food processes, and the like. More particularly, the invention is directed to a continuous drying apparatus which utilizes conveyor belts to move moist material which is to be dried through a plurality of vertically stacked heating chambers, through which hot gases are passed in a generally upwardly direction to the material which is to be dried, and which include a plurality of radiative-type heating devices.

Various drying apparatuses have been employed to remove liquids, especially water, from a variety of waste product streams in order to lower the moisture content of the waste to reduce costs associated with transporting the waste to a landfill. Additionally, drying or dewatering of such wastes is frequently required before the landfill operator can allow disposal of the waste at the landfill site. Known continuous apparatus have generally been designed with a relatively narrow width and height and a relatively long linear flow path. As a result, known continuous drying apparatuses have a relatively high ratio of external surface area to drying volume which leads to heat losses through the top, floor, and sidewalls of the dryer which can be higher than might be desirable. Also, the linear flow path of most drying apparatuses often requires more floor space than might be desirable.

Another disadvantage of known drying apparatuses is that they are generally designed so that the moist solid or semi-solid material which is to be dried travels through the dryer unit at a constant velocity, even though the material continuously loses mass and volume due to the evolution of moisture as it travels through the dryer unit. This results in inefficient utilization of the drying and mass handling capacity of the apparatus.

Accordingly, it is an objective of the invention to provide a drying apparatus which is more compact, achieves lower heat losses through the walls, floor, and top of the dryer unit, and which can more efficiently utilize the heating and mass handling capacity of the dryer unit.

SUMMARY OF THE INVENTION

The invention provides a reliable, energy efficient, substantially non-polluting apparatus for continuously drying moist solid materials, such as sludge and various other waste materials from which a significant amount of water must be removed before further processing or disposal at a land fill site.

The continuous drying apparatus of the invention includes a housing generally having a floor, sidewalls, and a top which define an enclosed dryer volume which is divided into a plurality of stacked heating chambers, each of which has associated therewith a conveyor belt for transporting moist solid or semi-solid materials therethrough. The speed of each of the conveyor belts associated with the plurality of stacked heating chambers can be individually controlled to permit more efficient utilization of the mass handling and drying capacity of the drying apparatus.

The apparatus utilizes a combination of convective and radiative heat transfer to achieve efficient drying of the solid or semi-solid material passing therethrough. More specifically, heated air or gas is introduced into the lowermost of the stacked heating chambers and flows upwardly through each of the heating chambers and through the solid or semi-solid material being transported through each of the heating chambers, and is exhausted from the uppermost of the heating chambers. The solid or semi-solid materials are introduced onto the conveyor in the uppermost of the heating chambers and are transported across each heating chamber and deposited downwardly onto the conveyor of an adjacent lower heating chamber and discharged from the lowest of the heating chambers.

A preferred aspect of the invention involves the use of gas diffuser plates for dividing the dryer volume into a plurality of heating chambers. Each of the gas diffuser plates has a plurality of apertures which allow the gas introduced into the drying apparatus to rise upwardly from an underlying plenum or heating chamber and to be distributed substantially uniformly through the solid or semi-solid material supported above the gas diffuser plate.

In accordance with another preferred aspect of the invention, the gases exhausted from the uppermost of the stacked heating chambers are directed to a heat exchanger to recover thermal energy. More desirably, the recovered thermal energy is used to heat the air or gas which is introduced into the drying apparatus at the lowest of the stacked heating chambers.

In accordance with another preferred aspect of the invention, the conveyor belt is a metal mesh belt which is supported on the gas diffuser plates. The belt is comprised of a continuous loop having openings which mesh with the teeth of a sprocket fixed to a drive shaft operatively connected to a variable speed motor.

The radiative heating units are preferably comprised of infrared heating units, microwave heating units, or a combination of infrared and microwave heating units.

In accordance with a further aspect of the invention, the apparatus preferably includes an inclined vibrating conveyor pan having diverter vanes which distribute the solid or semi-solid material to be dried uniformly along the length of a feed hopper and hence along the width of the conveyor belt in the uppermost heating chamber to facilitate more uniform heating and drying of the material.

The apparatus preferably includes a rotary airlock in the inlet feed hopper which deposits the solid or semi-solid material which is to be dried onto the conveyor in the uppermost heating chamber, while restricting the flow of gas outwardly through the inlet feed hopper, thereby minimizing convective heat loss through the inlet feed hopper.

Plows are desirably situated above the conveyor belts to turn the solid or semi-solid material over in order to achieve more uniform heating and drying of the material.

The stacked heating chamber arrangement of the drying chambers results in a dryer unit design having a lower ratio of external surface area to drying volume than known apparatuses, which results in lower heat loses through the walls, top, and floor of the dryer. The stacked heating chamber arrangement of the invention also results in a more compact dryer which requires less floor space than a conventional apparatus having a linear material flow path. Another advantage of the stacked heating chamber arrangement is that the conveyor associated with each of the heating chambers can be operated at a different speed, so that more efficient utilization of the material handling and drying capacity of the apparatus can be achieved.

These and other features, objects, and benefits of the invention will be recognized by those who practice the invention and by those skilled in the art, from the specification, the claims, and the drawing figures.

DESCRIPTION OF THE PREFERRED EMBODIMENTS

Figure 1:
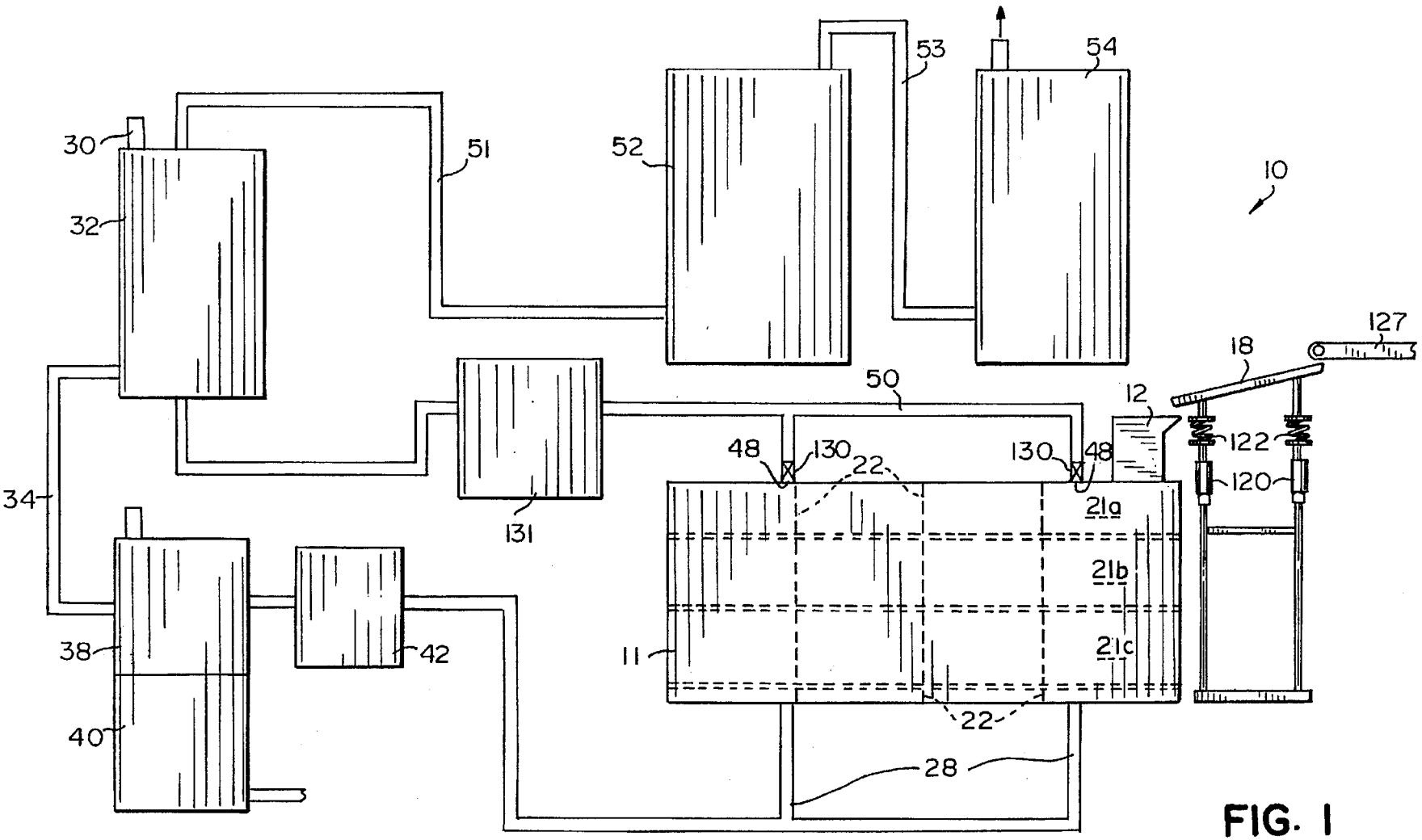
FIG. 1 is a schematic representation of a drying apparatus in accordance with the invention.
Figure 2:
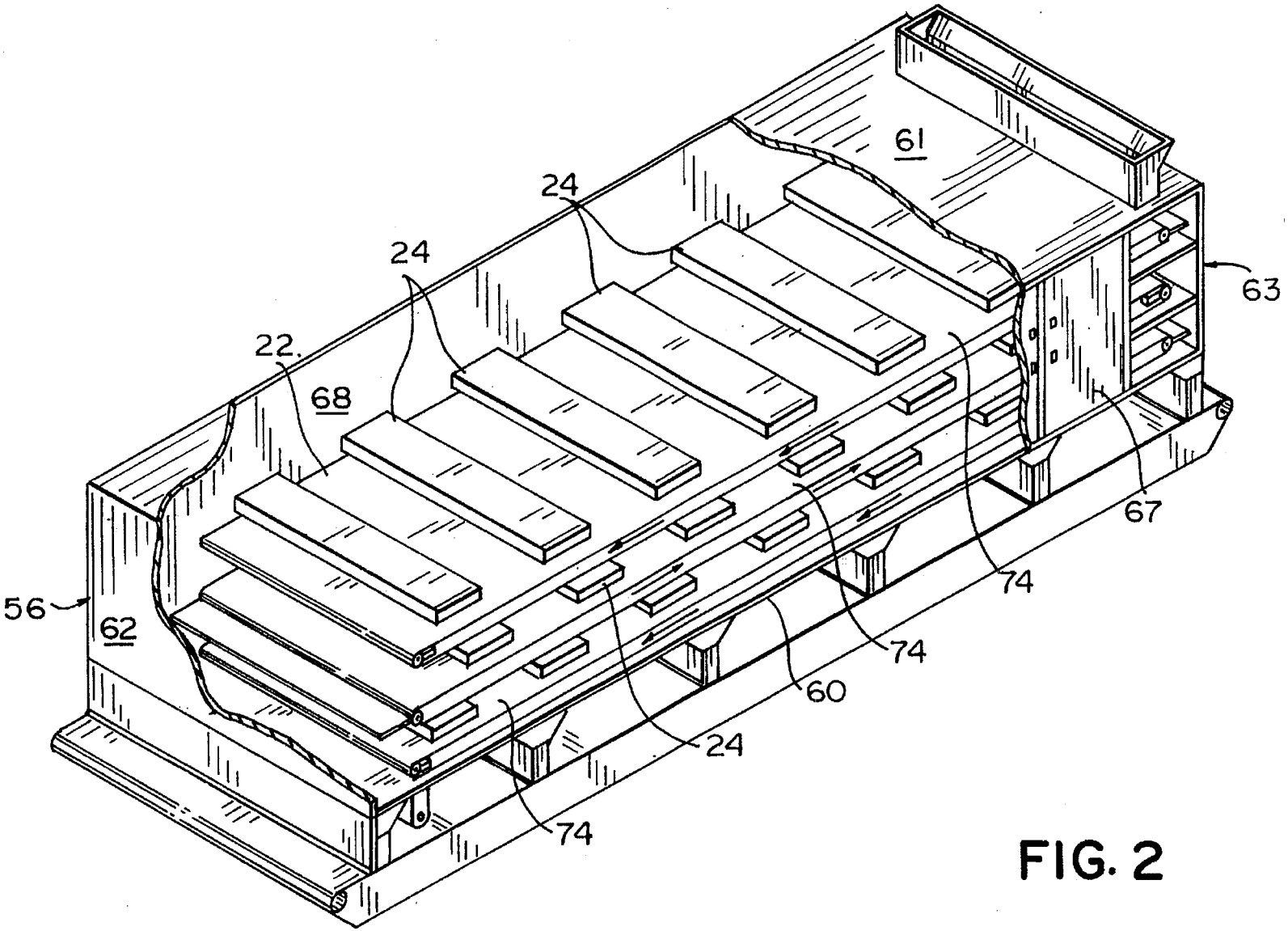
FIG. 2 is a perspective view of the dryer unit used in the apparatus shown in FIG. 1.
Figure 3:
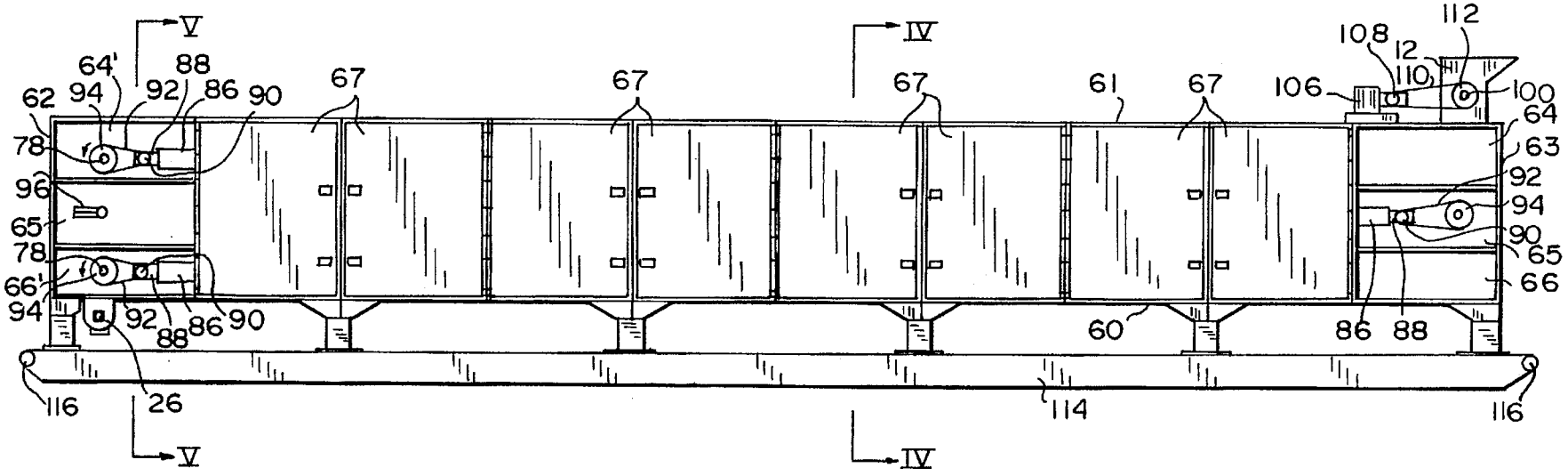
FIG. 3 is a front elevational view of the dryer unit.
Figure 4:
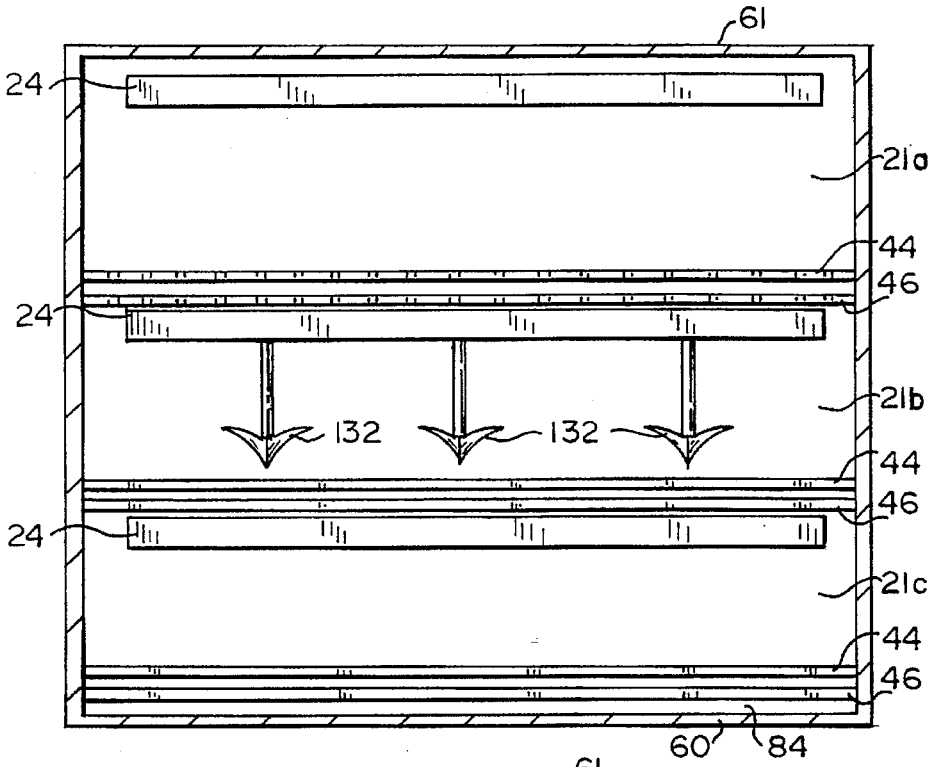
FIG. 4 is a transverse cross-sectional view along lines IV—IV of FIG. 3.
Figure 5:
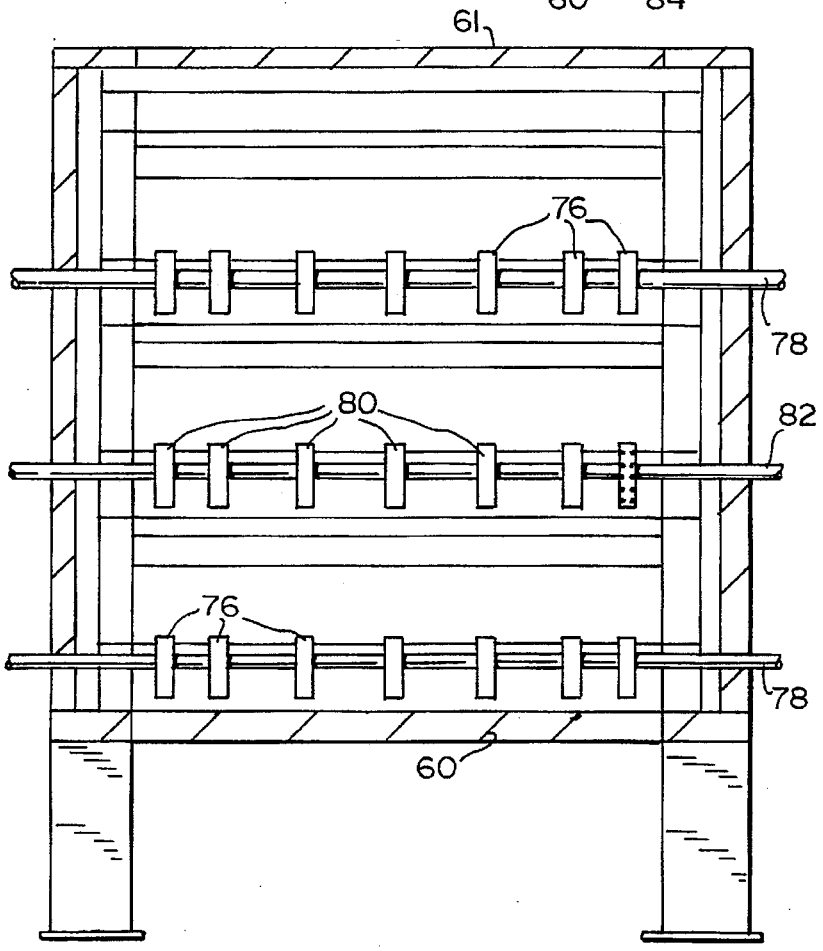
FIG. 5 is a cross-sectional view along lines V—V of FIG. 3.
Figure 6:
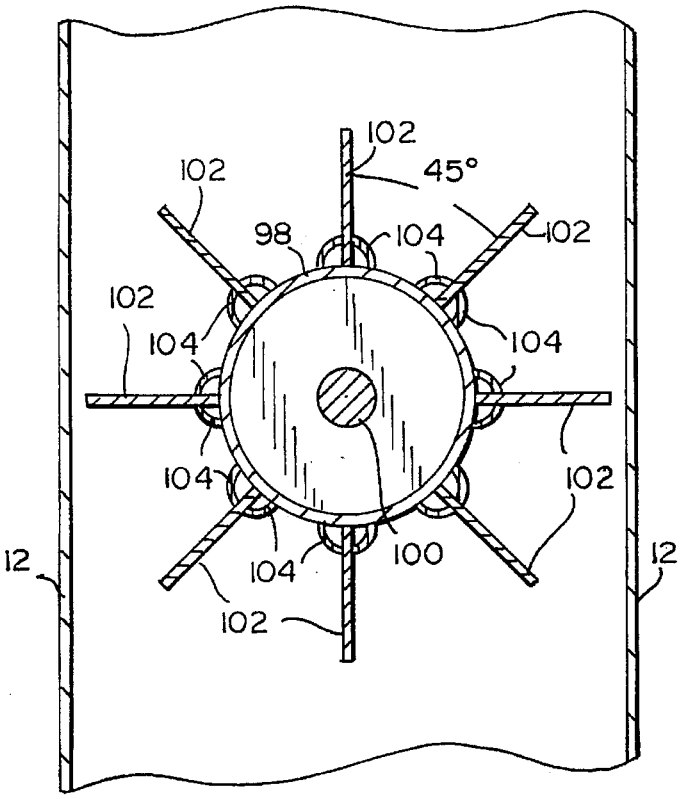
FIG. 6 is a cross-sectional view along lines VI—VI of FIG. 2.

The drying apparatus 10 of the invention (FIG. 1) includes a dryer unit 11 having an inlet feed hopper 12 containing a rotating valve air lock 14 (FIG. 6) which introduces moist materials, which are to be dried, into the dryer unit 11 while minimizing the escape of pressurized gases from the drying unit, thus minimizing heat losses at the inlet to the dryer unit. The material is introduced into the feed hopper from a vibrating conveyor pan 18 which distributes the material uniformly across the length of the feed hopper 12 to promote uniform heating and thus efficient drying of the material. The material, which is to be dried, passes through a series of vertically stacked drying chambers 21*a*, 21*b*, 21*c*, each of which includes baffles 22 which further divide the vertically stacked heating chambers into a plurality of adjoining heating zones to permit individual heating and temperature control at each of the zones. The material is moved through each of the stacked heating chambers by a conveyor belt 74 and dropped down onto the next, lower heating chamber, and finally discharged from the lowest of the stacked heating chambers through a screw conveyor 26 (FIG. 3). Material to be dried is heated by a plurality of radiative heating units 24 disposed within each of the heating chambers 21*a*, 21*b*, 21*c*, and by heated air which enters the lowest stacked chamber 21*c* through ducts 28. Air which is used to effect convective heat transfer to the materials which are to be dried is drawn in through an inlet pipe 30 to an air to air type heat exchanger 32 where it is preheated by indirect heat exchange with hot exhaust gases exiting the dryer unit 11. The preheated air exits the air to air heat exchanger 32 through duct 34 and enters another air to air type heat exchange 38 where heat is transferred indirectly from combustion products exiting combustion chamber 40 to the preheated air to further raise the temperature thereof. A blower 42 is used to introduce pressurized heated air into the lowest heating chamber 21*c*. The heated, pressurized air rises upwardly and passes through a plurality of apertures in gas diffuser plates 44, 46 (FIG. 4) which support a conveyor belt associated with each of the chambers 21*a*, 21*b*, 21*c*. The gas rises through the dryer unit, passing successively through each of the chambers, and is exhausted from gas outlets 48 at the top of the dryer unit. As the gas rises through the dryer unit it absorbs moisture from the material which is being dried. The exhaust gases from outlets 48 flow through duct 50 to air to air heat exchanger 32 where the exhaust gases give up thermal energy to fresh air entering inlet pipe 30. The exhaust gases exiting heat exchanger 32 flow, via duct 51, to an electrostatic precipitator 52 to remove particulate matter, and through duct 53 to a packed bed scrubber 54 to remove contaminants, such as volatile organic matter, before being discharged into the atmosphere.

The dryer unit 11 (FIGS. 2–5 and 9) comprises a drying volume defined by a housing 56 having a floor 60; a top 61; end walls 62, 63; a front wall comprised of fixed partitions 64, 65, 66 and 64', 65', 66' which are bolted to the frame of the dryer unit near the ends thereof, and a plurality of removable front access panels 67 which allow for cleaning and servicing of the dryer unit; and a back wall 68 having a plurality of openings 70 for receiving radiative heating units 24. The exterior walls and top of the housing are preferably insulated with a conventional insulating material. The dryer unit 11 includes a plurality of gas diffuser plates 44, 46 which divide the dryer unit into a plurality of parallel heating chambers 21*a*, 21*b*, 21*c* which are stacked one above another. More specifically, each of the three heating chambers of the illustrated dryer unit 11 has associated therewith an upper gas diffuser plate 44 which is generally arranged with its longitudinal and transverse axes in a horizontal plane, and a lower gas diffuser plate 46 which is substantially parallel with its associated upper gas diffuser plate and is relatively closely spaced therebelow. The upper plate 44 associated with each of the chambers 21*a*, 21*b*, 21*c* is spaced above the lower plate 46 by about the minimum distance which is sufficient to allow an endless metal mesh conveyor belt 74 to pass over the top plate 44, downwardly around a plurality of sprocket gears 76 fixedly secured to a horizontally arranged drive shaft 78 located at one end of the parallel plates 44, 46, over the lower plate 46, and upwardly around a plurality of sprocket gears 80 fixedly secured to a horizontally arranged idler shaft 82 located at the other end of the parallel plates.

The endless metal mesh belts 74 associated with each of the heating chambers 21*a*, 21*b*, 21*c* are each driven by a variable speed electric motor 86*a*, 86*b*, 86*c*, respectively. The electric motor 86 for each of the heating chambers 21*a*, 21*b*, 21*c* is operatively coupled to a gear reduction assembly 88 associated with each heating chamber 21*a*, 21*b*, 21*c*, respectively. The gear reduction assembly 88 includes a sprocket 90 which engages a drive chain 92 which meshes with the teeth of a drive sprocket 94 fixedly secured to drive shaft 78. A variable speed electric motor 86 is selected so that the speed of each of the belts can be individually controlled. The idler shaft 82 associated with each of the heating chambers 21*a*, 21*b*, 21*c* is supported for adjustable tensioning of the belt 74. The adjustable tensioners 96 are adjusted to maintain adequate tension on the belt 74 so that the teeth of sprockets 76 on drive shaft 78 and the teeth of sprockets 80 on idler shaft 82 continuously engage openings in the metal mesh belt. The metal mesh belt 74 of the illustrated dryer unit is about 80 feet long and forms an endless loop about 40 feet long and about 60 inches wide with openings which are about ½ inch by ½ inch. The belt 74 is preferably made of steel and should be capable of withstanding the temperatures which are maintained in the dryer unit 11, generally from about 300° F. to about 800° F.

The gas diffuser plates 44, 46 serve the dual functions of supporting the metal mesh conveyor belt 74 and of uniformly distributing hot gases rising upwardly from a plenum 84, in the case of the lowest heating chamber 21*c*, or from a lower heating chamber. The apertures in the gas diffuser plates are typically from about ½ inch to about 1 inch in diameter and are preferably spaced apart in a manner which will facilitate relatively uniform distribution of the gases rising through the material passing through the heating chambers 21*a*, 21*b*, 21*c*. Typically, the apertures are uniformly spaced apart in a regular geometric pattern. The number of apertures and the size thereof is generally sufficient to permit about 2000 cubic of gas to flow through the dryer unit 11 for every ton of material to be dried which is fed into the dryer unit, when a pressure differential across the dryer unit from the plenum 84 to the exhaust outlet 48 is from about 0.5 to about 5 psi. The actual number of apertures, size of the apertures, and the arrangement thereof which is suitable for achieving a desired outlet moisture content for a given material having a given inlet moisture content can be readily determined by those skilled in the art.

In accordance with the illustrated dryer unit 11, each of the three stacked heating chambers 21*a*, 21*b*, 21*c* is divided into four heating zones, each of which is approximately 10 feet long, by baffles 22. The baffles 22 restrict convective heat transfer (flow of gases) between laterally adjacent heating zones, as well as radiative heat transfer between adjacent zones. The baffles can be generally any type of vertical wall which extends across the heating chamber, but only partially so as not to interfere with the conveyor or material carried thereon. By dividing the illustrated dryer unit 11 into twelve heating zones with heat transfer restrictions between the zones, it is possible to achieve a certain degree of individual temperature control within each of the zones by controlling the amount of radiative thermal energy supplied by the radiative heating units in each of the zones. Temperature control within each of the heating zones can be achieved using conventional temperature sensing devices, such as thermocouples, and automatic controllers or microprocesses which control the radiative heating units 24. By allowing individual temperature control within each of the zones, especially in combination with the ability to operate the belt 74 associated with each of the heating chambers 21*a*, 21*b*, 21*c* at a different speed, it is possible to heat the materials which are to be dried in accordance with an optimally efficient heating schedule.

The radiative heating units 24 are generally any of various infrared heating units which are commercially available. Suitable infrared heating units include fuel burning infrared heating devices such as porous media-type devices which have a reverberating screen suspended above a burner, flame impingement-type heating devices wherein infrared radiation is emitted from refractory material impinged upon by a flame, catalytic-type infrared heating devices, and the like. Any of various electric infrared heating devices can also be used with the invention. The number and type of infrared heating units which can be utilized is a matter of design choice which depends on the properties (e.g. permeability) of the material which is to be dried, the amount of material which is to be dried, and on the starting and desired outlet moisture content of the material. The selection of suitable infrared heating units and the number of such infrared heating units which are to be incorporated into a particular dryer can be determined by those skilled in the art. The radiative heating units 24 are mounted, such as on racks or rails, above the conveyor belts 74 in each of the heating chambers 21*a*, 21*b*, 21*c*, so that radiative energy (such as infrared or microwave radiation) is directed downwardly onto material carried by the conveyors.

The inlet feed hopper 12 is a generally rectangular chute which extends along the width of the metal mesh conveyer belt 74 associated with the upper heating chamber 21*a* at an end thereof. Rotatably mounted in the inlet feed hopper 12 is a rotary air lock 14 (FIG. 6) which delivers material to be dried onto the conveyor belt 74 of heating chamber 21*a*, while minimizing convective heat losses by restricting the flow of hot, pressurized gases from the dryer unit 11 to the atmosphere through feed inlet hopper 12. Minimizing escape of such gases can also be important in some cases to minimize air pollution, such as when volatile organic compounds are vaporized during drying of materials containing such compounds. The air lock 14 includes a cylindrical shell 98 fixedly attached to a shaft 100 journalled on opposing walls of inlet feed hopper 12. A plurality of vanes 102 extend radially from the outer surface of the cylindrical shell 98. The cylindrical shell 98 and vanes 102 are preferably made of steel or other suitable metal. The vanes 102 in the illustrated air lock are circumferentially disposed about the cylindrical shell 98. The angular spacing between the vanes 102 and the length of the vanes are selected so that air losses from the dryer unit 11 through the inlet feed hopper 12 is kept to a minimum while the material which is to be dried is allowed to fall freely from the vanes 102 onto the conveyor in the upper heating chamber 21*a*. The minimum clearance between the outward edges of vanes 102 and the walls of hopper 12 is generally great enough to prevent any possibility of contact therebetween. Accordingly, the airlock 14 does not provide an airtight seal. However, as moist material is deposited into the hopper, the material itself tends to act as a partial seal by blocking the gaps between the airlock and the walls of the inlet feed hopper 12 as it drops down on to the conveyor 74 of the upper heating chamber 21*a*. Mounting the vanes 102 onto a cylindrical shell 98 secured to shaft 100 allows for reduced mass of the airlock as compared with a solid shaft having the diameter of the shell 98. The larger radius curved surfaces of shell 98, as compared with shaft 100, help reduce the risk of material becoming wedged between adjacent vanes 102, as would tend to occur if the vanes were attached directly to shaft 100. Also provided are curved sections 104 secured to vanes 102 and shell 98 to eliminate the relatively sharp corners between the shell 98 and vanes 104, thereby further reducing the risk of material becoming wedged between surfaces of the airlock 14. The illustrated airlock 14 has eight vanes 102 which are equally spaced apart about the circumference of the shell 98 by a 45° angle. The number and spacing of the vanes is not critical, however, to reduce wear on the motor 106 driving the rotating airlock 14 it is generally necessary to space the vanes apart equally, and an even number of vanes is generally desirable to provide better balance of forces on shaft 100. Also, more vanes would tend to increase the risk of material becoming wedged between surfaces of the airlock, and fewer vanes would tend to increase the amount of escaping gases and associated heat losses through the inlet feed hopper 12. The output shaft of motor 106 has a sprocket 108 which engages a drive chain 110, which in turn engages the teeth of sprocket 112 fixedly secured to shaft 100 of airlock 14.

The dried material outlet could include an airlock generally similar to the inlet airlock 14. However, the illustrated drying unit is shown with an auger or screw-type discharge conveyor 26 which discharges the dried material from the side of the dryer unit 11. Suitable auger or screw-type conveyors are well known and commercially available.

The dryer unit 11 is preferably constructed from steel members and steel plates or sheets, although other suitable metals can be used, if desired. The dryer unit 11 is preferably mounted on a skid 114 having lifting lugs 116 to facilitate transportability.

Figure 7:
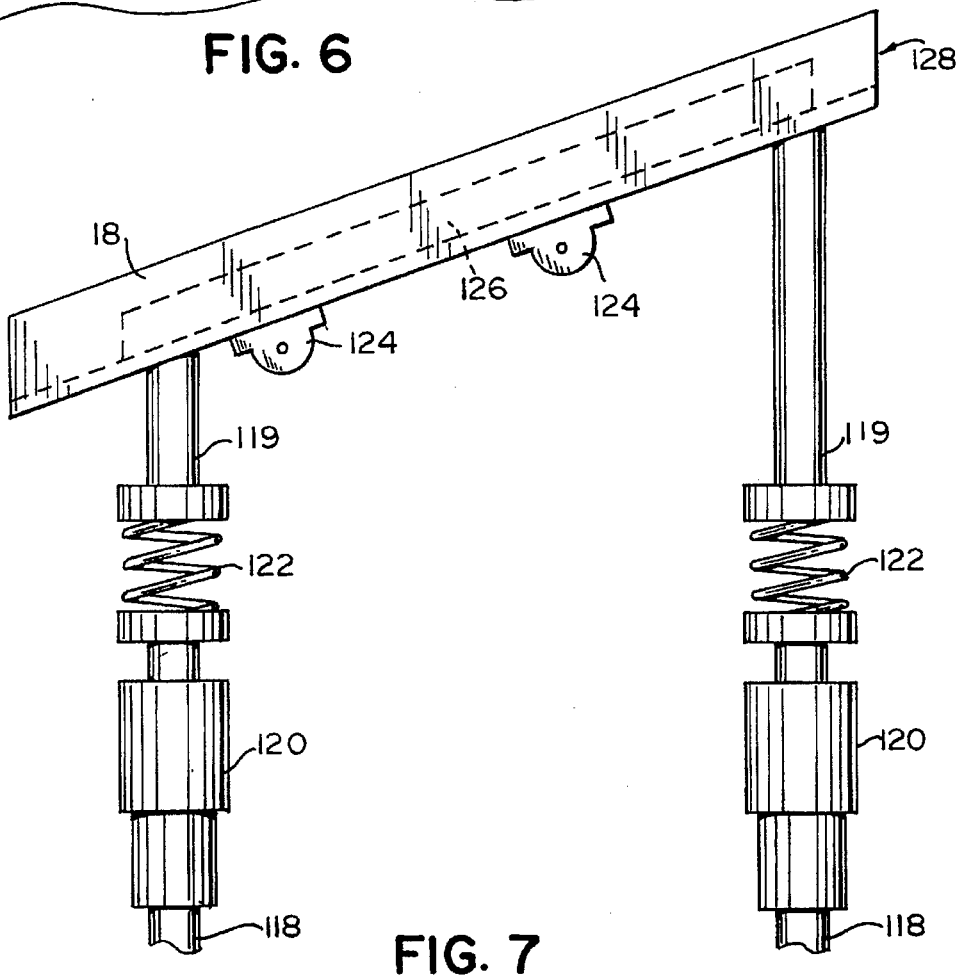
FIG. 7 is an elevational view of the vibrating conveyor pan used to deposit material into the inlet feed hopper of the dryer unit.
Figure 8:
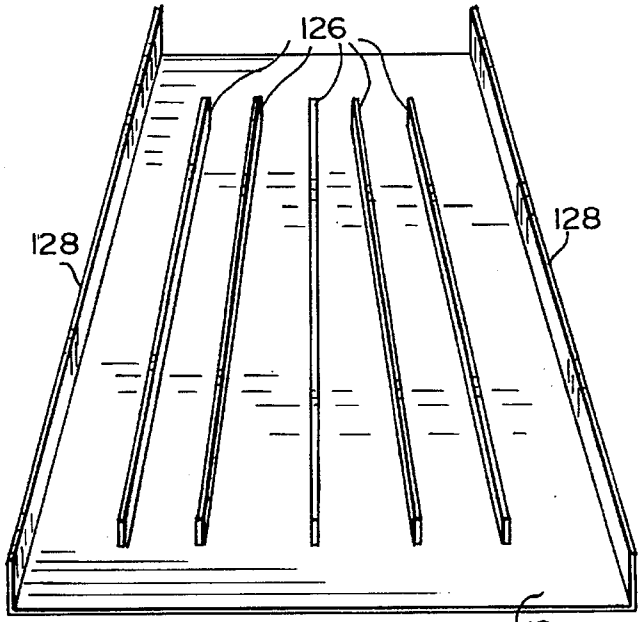
FIG. 8 is a top view of the vibrating conveyor pan shown in FIG. 7.
Figure 9:
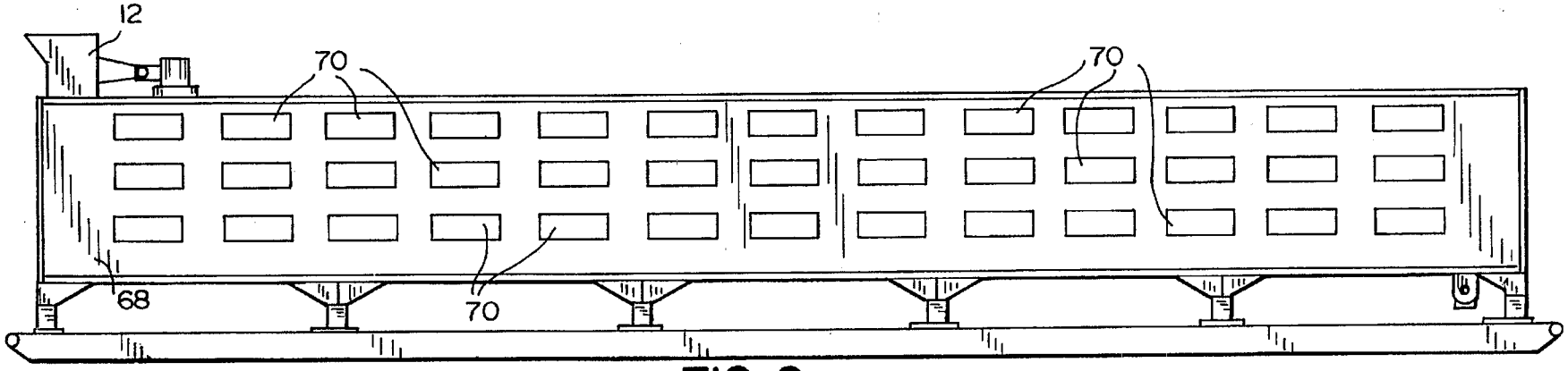
FIG. 9 is a rear elevational view of the dryer unit.

The material which is to be dried is preferably deposited uniformly over the area of the conveyor belt 74 of the upper heating chamber 21*a*, so that efficient, uniform heating and drying of the material can be achieved. To help facilitate uniform distribution of material, a vibrating conveyor pan 18 (FIGS. 7 and 8) is preferably used to spread the material uniformly across the length thereof before the material is deposited in the hopper 12. The vibrating conveyor pan 18 is mounted for oscillatory or vibratory motion relative to a comparatively stationary base 118. More specifically, the vibrating conveyor pan 18 is attached to the base 118 by a plurality of legs 119, each of which has a shock absorber 120 and a spring 122 which allow the pan 18 to freely vibrate relative to the base 118.

Attached to the pan 18 are vibrators 124 which cause material sliding down the face of the pan to move randomly and become redistributed on the face of the pan, with the overall or net effect being that the material is more uniformly distributed across the width of the pan 118. Any of various electromagnetic or mechanical vibrators known to the art can be utilized to help spread the material evenly across the width of the pan 18. The conveyor pan includes a plurality of diverter vanes 126.

To help spread material evenly across the width of the pan, the conveyor pan includes a plurality of diverter vanes 126. Most preferably the diverter vanes, which guide and spread material outwardly across the width of the lower edge of the pan, are adjustable. For example, the pan 18 can be provided with a plurality of apertures for fastening the diverter vanes 126 at any of various angles.

The face of the pan 18 is angled downwardly away from a feed conveyor 127 (FIG. 1), which drops material on to a relatively narrower upper edge of the pan, and toward the inlet hopper 12. Material slides downwardly toward and over the relatively wider lower edge of the pan 18 and falls into the hopper 12. The lower edge of the pan 18 is preferably of a length about equal to the width of the conveyor belts 74. The angle or incline of the face of the pan 18 is not critical and can vary from a few degrees, such as 5 or 10 degrees, up to 40 degrees or more, depending on the properties of the material and on the amount of vibration induced by vibrator 124. A suitable angle or incline for the pan 18 is readily determinable by those skilled in the art. The edges of the pan 18 are preferably provided with upright sidewalls 128 which prevent material from falling off over the sides of the pan.

Exhaust outlets 48 are preferably provided with dampers, valves, or other flow regulating devices 130 which can be adjusted to control the flow path of air and other gases through the dryer unit 11, and to control the flow rate and pressure drop across the dryer unit.

An exhaust fan 131 helps draw air and other gases from the exhaust outlets 18 at the top of the dryer unit 11 and directs the air and other gases through duct 50 to the air to air heat exchanger 32 where heat is recovered and used to preheat fresh air supplied to the dryer unit. Heat exchanger 32 is preferably of a fixed plate design, and the exhaust air entering the heat exchanger 32, preferably flows counter-current to the fresh air which is being preheated to provide a greater average temperature difference across the heat transfer surfaces to achieve higher heat transfer rates.

The heat exchangers 32 and 38, combustion chamber 40, electrostatic precipitator 52, and gas scrubber 54 are all of a conventional design and do not, of themselves, constitute the invention.

In operation, material to be dried is transferred and deposited along the upper edge of vibrating conveyor pan 18 by a conventional feed conveyor 127. The material slides downwardly along the conveyor pan 18 as it vibrates and becomes uniformly distributed and spread outwardly over the downwardly widening pan 18. The outward spreading and the uniform distribution of the material is achieved by the combination of vibrators 124 and diverting vanes 126. The material drops into hopper 12 and falls onto vanes 102 of airlock 14. As the air lock 14 rotates, the material is dropped onto the metal mesh conveyor belt 74 in the upper heating chamber 21*a*. As the material is transported by belt 74 through chamber 21*a*, it is heated from above by radiative heating units 24, and convectively heated by gas and air rising upwardly through has diffuser plates 44, 46. When the material reaches the end of the conveyor in the upper heating chamber 21*a* it falls from the belt of the upper chamber 21*a* and drops onto the next conveyor belt 74 in chamber 21*b*. The material then moves in the opposite direction through chamber 21*b* and is heated from above by radiative heating units 24, and from below by air and gases passing upwardly through the gas diffuser plates 44, 46 from chamber 21*c*. When the material reaches the end of the second chamber 21*b*, it drops down to the last conveyor 74 in chamber 21*c*, where the material is heated from above by radiative heating units and from below by air rising through diffuser plates 44, 46 from plenum 84. After the material reaches the end of the last or lowest chamber 21*c*, it is discharged from the dryer unit through screw conveyor 112.

Plows 132 can be situated at selected locations above the conveyor belts 74 to turn the material over in order to achieve more uniform heating throughout the material.

It is often desirable to rapidly heat the material in the first or upper chamber 21*a* to boil or volatilize any moisture on the surface of the material. That is to say, it is often desirable to concentrate radiative heating in the first heating chamber 21*a*. This can be achieved by using more heating units in the upper chamber 21*a*, applying more fuel or electrical current (as appropriate) to the heaters, and/or using heaters having a higher energy rating. As another possibility, it is desirable for certain applications to utilize microwave heating units in the first chamber. Microwave heating devices are well known in the art, and those having ordinary skill in the art can easily select or design appropriate microwave heaters. Microwave heating is particularly useful for drying materials containing water or other organic liquids, but is not be recommended for drying moist solid materials wherein the moisture or wetness is attributed primarily to non-polar liquids, or only slightly polar liquids.

The number of stacked heating chambers and conveyor belts, the number of heating zones, the number and type of types of heating elements, and the dimensions of the dryer unit can all be varied without departing from the principles of the invention. For example, any number of a plurality of stacked heating chambers can be used to reduce heat losses and improve energy efficiency by reducing the ratio of exterior surface area to internal volume of the dryer unit. Also, by stacking a plurality of heating chambers it is possible to provide a given drying capacity using a more compact dryer unit which requires less space and floor area.

Additionally, it should be appreciated that by providing a dryer unit having a plurality of heating chambers, each of which has a conveyor belt which can be operated at a speed different from that of the others, it is possible to achieve a more efficient drying operation which better utilizes the volume capacity of the apparatus. As sewerage sludge or other similar materials pass through a dryer, a considerable amount of water is removed, which results in a substantial reduction in the mass and volume of material which is being conveyed through the dryer unit as it progresses therethrough. With conventional continuous drying apparatuses, wherein the material to be dried is moved through the dryer unit at a constant velocity, efficient utilization of drying capacity is generally not achieved throughout the entire length of the dryer unit. With the invention, however, it is possible to operate the conveyors at successively slower (or faster) speeds as the material passes through the dryer unit so that more efficient utilization of drying capacity can be achieved throughout the material path length of the dryer unit.

While the apparatus of the invention is particularly useful for removing water from sewerage sludge and similar waste streams, it can be used to remove water or other liquids from a variety of materials. For example, the apparatus of the invention can be adapted for use in removing volatile organic liquids from solids containing such compounds. As another example, the invention can be adapted for use in removing water from food by-product waste streams, such as seafood waste or orange pulp.

It will be understood by those who practice the invention and by those skilled in the art, that various modifications and improvements may be made to the invention without departing from the spirit of the disclosed concept. The scope of protection afforded is to be determined by the claims and by the breadth of interpretation allowed by law.

The embodiments of the invention in which an exclusive property or privilege is claimed are defined as follows:

1. A continuous drying apparatus for removing liquid from a moist solid or semi-solid material, comprising:

a housing generally having a floor, opposing sidewalls, and a top, said housing enclosing a dryer volume which is divided into a plurality of stacked heating chambers by plates extending between the opposing sidewalls;

a plurality of conveyor belts;

each of said heating chambers containing one of said plurality of conveyor belts, the conveyor belt in each of the heating chambers above the lowermost heating chamber transporting said solid or semi-solid material through said heating chamber and depositing said solid or semi-solid material on a different conveyor belt in an adjoining lower heating chamber, the conveyor belt in the lowermost of said heating chambers transporting said solid or semi-solid material through said lowermost chamber and to an outlet for discharging said solid or semi-solid material from said drying apparatus;

at least one radiative heating unit mounted above said conveyor belt in at least one of said heating chambers so that radiation is directed downwardly onto material carried by said conveyor belt;

an inlet feed hopper for depositing said material onto said belt in the uppermost of said plurality of stacked drying chambers; and a gas outlet for exhausting gas from the uppermost of said stacked heating chambers wherein at least one of said heating chambers includes at least one vertically arranged baffle which extends across the at least one heating chamber transverse to the conveyor belt disposed within the at least one heating chamber and which divides said at least one heating chamber into a plurality of heating zones to facilitate localized temperature control in said heating chamber.

2. The apparatus of claim 1, wherein said dryer volume is divided into a plurality of stacked heating chambers by gas diffuser plates, each of which has a plurality of apertures which allow gas to rise upwardly from an underlying plenum or heating chamber and be distributed substantially uniformly through solid or semi-solid material supported above said gas diffuser plate.

3. The apparatus of claim 1, wherein said gas exhausted from the uppermost of said stacked heating chambers is directed to a heat exchanger to recover thermal energy.

4. The apparatus of claim 3, wherein said heat exchanger is an air to air type heat exchanger which transfers thermal energy from said gas exhausted from the uppermost of said stacked heating chambers to gas which is introduced into the lowermost of said stacked heating chambers.

5. The apparatus of claim 2, wherein said conveyor belt is a metal mesh belt which is supported on said gas diffuser plates.

6. The apparatus of claim 1, wherein said radiative heating units are infrared heating units.

7. The apparatus of claim 1, wherein said radiative heating units are microwave heating units.

8. The apparatus of claim 1, wherein said radiative heating units comprise a combination of infrared heating units and microwave heating units.

9. The apparatus of claim 1, wherein said apparatus further comprises an inclined vibrating conveyor pan which deposits said solid or semi-solid material onto said inlet feed hopper, said vibrating conveyor pan being mounted to a base for vibrating motion relative to said base and having at least one vibrator mounted to said pan.

10. The apparatus of claim 9, wherein said inclined vibrating conveyor pan is wider at a lower edge thereof than at an upper edge thereof, and includes a plurality of diverter vanes for spreading said solid or semi-solid uniformly over said vibrating conveyor pan.

11. The apparatus of claim 1, wherein said inlet feed hopper contains a rotary airlock for depositing said solid or semi-solid material on said conveyor belt of the uppermost of said heating chambers, while restricting escape of gas from said dryer volume through said inlet feed hopper.

12. The apparatus of claim 11, wherein said rotary air lock is comprised of a plurality of vanes which extend radially from the outer surface of a cylindrical shell rotatably supported in said inlet feed hopper, the clearance between the outward edges of said vanes and the interior walls of said inlet feed hopper being about the minimum distance needed to prevent contact therebetween.

13. The apparatus of claim 1, wherein plows are situated above at least one of the conveyor belts to turn the solid or semi-solid material over in order to achieve more uniform heating throughout the material.

14. The apparatus of claim 1, wherein said gas flows upwardly from a plenum below the lowermost heating chamber, through a pair of spaced, parallel gas diffuser plates which support the forward and return portions of the conveyor belt associated with said lowermost heating chamber, through the conveyor belt supported on said gas diffuser plates associates with said lowermost heating chamber, through any material carried on said conveyor belt associated with said lowermost heating chamber; and wherein said gas continues to flow upwardly in a similar manner through the gas diffuser plates, conveyor belt, and any material carried on said conveyor belt, which are associated with the remainder of said plurality of stacked heating chambers.

15. The apparatus of claim 1, wherein said gas outlet includes an adjustable flow regulating device to control the flow rate and pressure drop across said dryer volume.

16. The apparatus of claim 1, wherein said apparatus includes a plurality of gas outlets including an adjustable flow regulating device, whereby the flow path of gases through said dryer volume is regulated, and wherein the flow rate and pressure drop across said dryer volume is controlled.

17. A continuous drying apparatus for removing liquid from a moist solid or semi-solid material, comprising:

a housing generally having a floor, sidewalls, and a top, said housing enclosing a dryer volume which is divided into a plurality of stacked heating chambers;

each of said heating chambers having a conveyor belt, the conveyor belt in each of the heating chambers above the lowermost heating chamber transporting said solid or semi-solid material through said heating chamber and depositing said solid or semi-solid material on a conveyor belt in an adjoining lower heating chamber, the conveyor belt in the lowermost of said heating chambers transporting said solid or semi-solid material through said lowermost chamber and to an outlet error discharging said solid or semi-solid material from said drying apparatus;

an inlet feed hopper for depositing said material onto said belt in the uppermost of said plurality of stacked drying chambers;

a gas outlet for exhausting gas from the uppermost of said stacked heating chambers; and a rotary air lock for depositing said solid or semi-solid material on said conveyor belt of the uppermost of said heating chambers, while restricting escape of gas from said dryer volume through said inlet feed hopper.

18. The apparatus of claim 17, wherein said rotary air lock is comprised of a plurality of vanes which extend radially from the outer surface of a cylindrical shell rotatably supported in said inlet feed hopper, the clearance between the outward edges of said vanes and the interior walls of said inlet feed hopper being about the minimum distance needed to prevent contact therebetween.

* * * * *

UNITED STATES PATENT AND TRADEMARK OFFICE

CERTIFICATE OF CORRECTION

PATENT NO. : 5,634,281
DATED : JUNE 3, 1997
INVENTOR : JAMES E. NUGENT

It is certified that error appears in the above-identified patent and that said Letters Patent is hereby corrected as shown below:

Column 8, Line 13;

"has" should be –gas–.

Column 10, Claim 14, Line 55;

"associates" should be --associated--

Column 11, Claim 17, Line 18;

"error" should be –for–.

Signed and Sealed this

Twenty-first Day of April, 1998

Bruce Lehman

*Attest:*

BRUCE LEHMAN

*Attesting Officer*

*Commissioner of Patents and Trademarks*